United States Patent [19]

Stuyvenberg

[11] 4,176,581

[45] Dec. 4, 1979

[54] AUDIO AMPLITUDE-RESPONSIVE LIGHTING DISPLAY

[76] Inventor: Bernard R. Stuyvenberg, 8149 Meadow, Warren, Mich. 48089

[21] Appl. No.: 855,413

[22] Filed: Nov. 28, 1977

[51] Int. Cl.[2] ..... A63J 17/00; A47G 33/16

[52] U.S. Cl. ..... 84/464 R; 362/232; 362/806

[58] Field of Search ..... 84/464; 362/232, 252, 362/367, 371, 458, 806, 811

[56] References Cited

U.S. PATENT DOCUMENTS

| | | | |
|---|---|---|---|
| 3,540,343 | 11/1970 | Rifkin | 84/464 |
| 3,610,918 | 10/1971 | Barlow | 362/232 |
| 3,723,723 | 3/1973 | Lerner | 362/806 |
| 4,000,679 | 1/1977 | Norman | 84/464 |

*Primary Examiner*—L. T. Hix

*Assistant Examiner*—S. D. Schreyer

*Attorney, Agent, or Firm*—Basile and Weintraub

[57] ABSTRACT

In a system for varying the intensity of a plurality of lights in accordance with plural channel audio amplitude signals, a display comprising a housing having multi-sided openings in the form of prismatic panels through which light passes from the interior of the housing. The housing mounts a plurality of banks of lights, certain of the lights being carried by a motorized member such that the lights rotate about a vertical axis. The banks of lights include a plurality of sets connected in a parallel fashion with each set having a selected number of lights connected in a series with a flashing unit. The lights are responsive to separate channels of audio amplitude signals, with each bank of lights being responsive to the amplitude of the associated channel of audio amplitude signals. A variety of window panels are disclosed.

3 Claims, 6 Drawing Figures

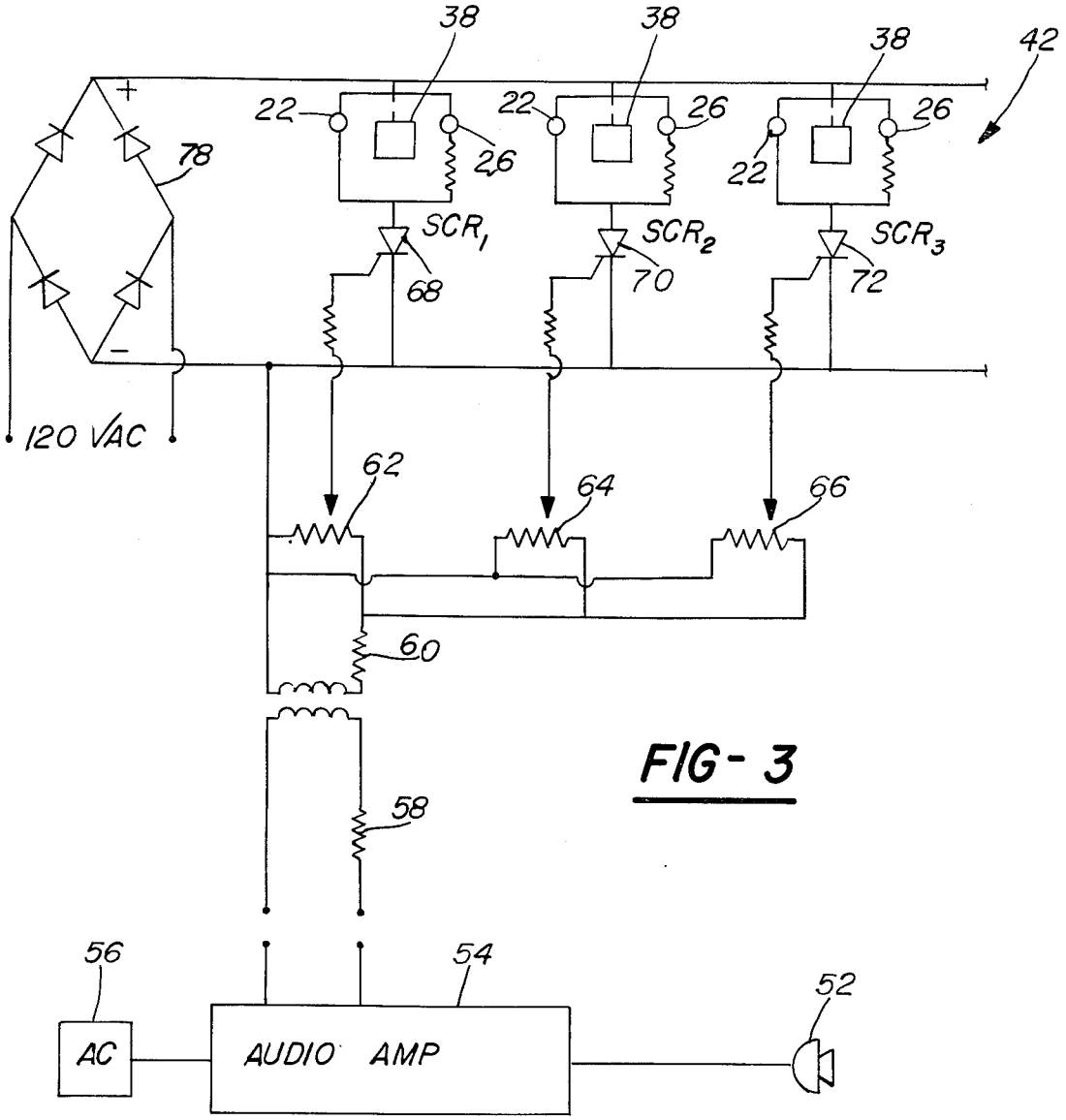
FIG-3
FIG-5
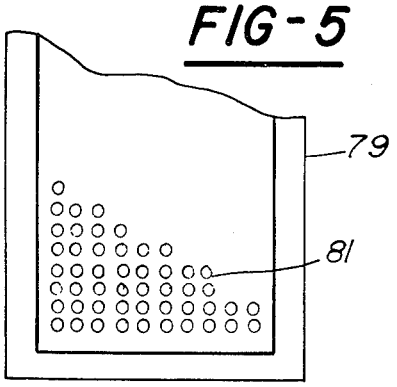
FIG-6
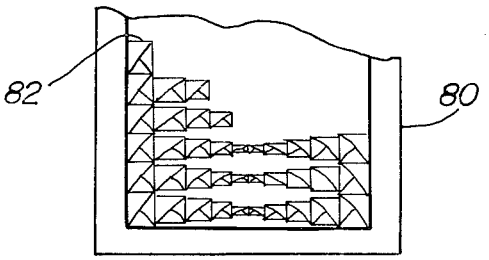

AUDIO AMPLITUDE-RESPONSIVE LIGHTING DISPLAY

BACKGROUND OF THE INVENTION

I. Field of the Invention

The present invention relates to audio amplitude lighting displays and, more particularly, to an audio amplitude lighting display providing a unique and novel display unavailable in the prior art devices.

II. Description of the Prior Art

There are many systems in the prior art for varying the intensity of a plurality of lights in accordance with an audio frequency signal emanating from a signal source, such as a record player, tuner, tape deck or the like. In such systems the output of the signal source is suitably amplified and fed to a frequency divider network, the separated plurality of frequencies then being amplified and fed to the plurality of lights so that the various lights brighten and dim as their associated frequencies occur, for example, in a musical program. Certain of the lights brighten when bass notes are played, other lights brighten with the middle frequencies, and still other lights brighten with the high frequencies, the intensities of the various lights varying with the intensity of the signals associated with the various frequencies.

However, the visual effects provided by such prior art systems have been largely confined to a display of successively or contemporaneously winking lights, and the dominant pervasiveness of a bass note, for example, is visually indistinguishable from the sharper, piercing high notes. Moreover, previous systems have not fully exploited the interesting visual effects which can be achieved by producing light images which not only vary in intensity in accordance with the audio amplitude signal, but which also are characterized by an apparent movement.

Examples of prior art apparatuses and devices which are known to applicant are disclosed in U.S. Pat. Nos. 3,215,022; 3,478,837; 3,808,721; 3,343,453; 3,611,603; 3,949,350; 3,205,755; and 3,241,419. Of the aforementioned patents, the apparatus disclosed in U.S. Pat. No. 3,241,419 represents the most relevant prior art known to applicant, and it discloses a display that has a twelve-channel frequency divider and associated electronics. This apparatus is a time-consuming, costly and complicated display. The twelve channels are divided into frequency ranges usually used for visual effects, say 500 to 5000 cps, resulting in each channel being so close (frequency wise) to an adjacent channel that the resultant light functions seem almost in unison with each other. Therefore, the twelve channels do not appear to flash in a true duplication of the sound source. It should also be noted that this aforementioned patent makes reference to the movement of lights, but it gives only the appearance of movement and does not actually provide for the movement of lights.

It would be desirable to provide a light display of the type disclosed herein which overcomes many of the aforementioned disadvantages of the prior art apparatus, yet one which is basically simple in design and construction and, thus, inexpensive to manufacture.

III. Prior Art Statement

In the opinion of the applicant and applicant's attorney the aforementioned prior art represents the closest prior art of which the applicant and applicant's attorney are aware.

SUMMARY OF THE INVENTION

In a system for varying the intensity of a plurality of lights in accordance with plural channel audio amplitude signals, a display comprises a housing having a plurality of windowed sections for the passage of light from the interior of the housing. A plurality of banks of lights are mounted within the housing, certain of the banks being fixedly attached to the interior of the housing, while a selected number are carried for rotation about a vertical axis. Each of the banks includes a plurality of sets connected in parallel, each set consisting of a selected number of lights connected in series with a flasher unit, the lights being responsive to separate channels of audio amplitude signals along with the flasher unit such that the lights flash on and off in a controlled, random manner.

It is therefore a primary object of the present invention to provide a light image display adapted for association with a system for varying the intensity of a plurality of lights in accordance with audio amplitude signals.

It is another object of the present invention to provide a visual display of the aforementioned character in which a plurality of banks are utilized, each of the banks being responsive to a separate channel of a plural-channel audio amplitude source, certain of the banks being mounted for rotational movement about a vertical axis.

It is yet another object of the present invention to provide a display of the aforementioned character in which a plurality of lights are mounted at different locations within a display housing and wherein the housing is provided with windowed apertures, selectively in the form of prismatic panels and/or apertured panels of a pegboard configuration.

Other objects, advantages and applications of the present invention will become apparent to those skilled in the art of lighting displays when the accompanying description of one example of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein:

FIG. 3 is a schematic drawing of one example of a circuit which may be employed with the lighting display illustrated in FIGS. 1 and 2 of the drawings;

FIG. 5 is a fragmentary front plan view of a window in the form of an apertured panel; and FIG. 6 is a front plan view of another modification of a window in the form of a prismatic panel having varying prismatic sections.

DESCRIPTION OF THE PREFERRED EMBODIMENT

Figure 1:
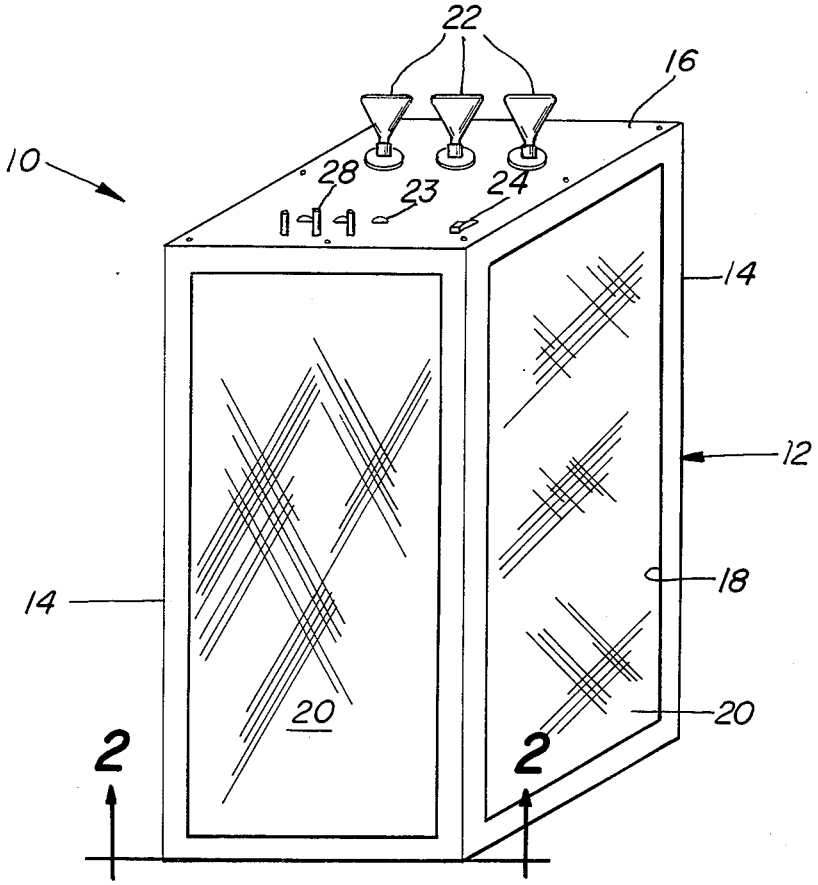
FIG. 1 is a perspective view of an audio amplitude-responsive lighting display constructed in accordance with the principles of the present invention.

Referring now to the drawing and, in particular, to FIG. 1 wherein there is illustrated one example of the present invention in the form of an audio amplitude-responsive lighting display 10. The display 10 comprises a housing 12 that is approximately two feet in width, two feet in length and four feet in height; however, it should be understood that its size is the preferred size, but other sizes and shapes may be found to be desirable. The housing 12 is made up of 1 ½ inch wooden strips 14 on which the frame sides are formed and which sides are enclosed at the top and bottom by suitable plywood covers 16 and 46, respectively. The formed sides of the housing 12 have windowed or apertured sections 18 which are enclosed by prismatic panels 20. The prismatic panels 20 extend from outer edge to outer edge, overlapping the wooden sections 14. In the preferred embodiment the overlapping sections of the panels 20 are painted a dark color, such as black, so as to blend in with the wooden sections therebehind. Typical panels of the prismatic type are commercially available and need not be described in further detail hereinafter. It should suffice to say that each panel 20 consists of a plurality of evenly spaced and square-based, female, or male, conical prisms placed parallel and perpendicular to the length and width of the panel 20.

The top cover 16 carries a plurality of spotlights 22 which are activated when the display 10 is on and provide added enjoyment in using the display, as they will provide multi-colored lights onto the ceiling of the room within this display 10 is located. The top also mounts an on-off switch 24, neon lights 26 and level controls 28, all of which will be described in greater detail hereinafter.

Figure 2:
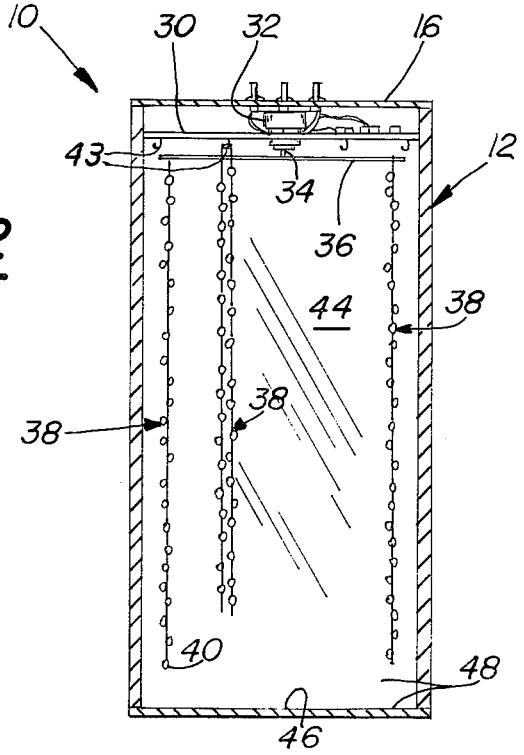
FIG. 2 is a longitudinal, cross-sectional view of the display taken along Line 2—2 of FIG. 1.

As can best be seen in FIG. 2 of the drawings, the interior of the housing 12 includes a support shelf 30 on which is mounted an electric motor 32. The electric motor 32 has a drive shaft 34 that extends downwardly for connection to a horizontal support rod 36, the outer ends of which carry a pair of banks 38 in the form of five sets of lights 40, all of which will be described in greater detail hereinafter.

While not shown in detail in FIG. 2, each bank of lights 38 includes suitable electric wiring that extends from the lights 40 across (or through as desired) the horizontal support rod 36 and through an appropriate electrical swivel carried by the drive shaft 34 for connection to a color organ circuit 42, which will be described in greater hereinafter. The back wall 44 and the bottom wall 46 are provided with a mirror 48 which covers the interior surfaces.

Figure 4:
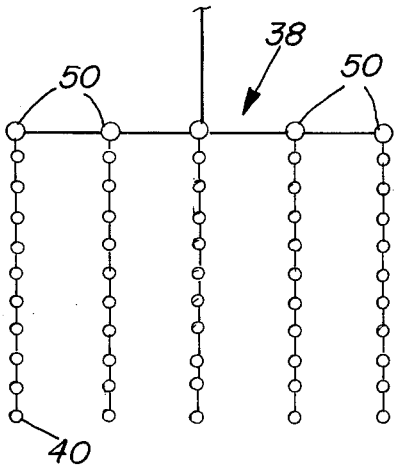
FIG. 4 is a schematic representation of a bank of lights utilized in the lighting display illustrated in FIGS. 1 and 2 of the drawings.

As can best be seen in FIG. 4 of the drawings, the banks 38 consist of five-way flasher Christmas tree lights which are colored, such as with blue, red, green, yellow and pink light bulbs 40. Each bank has a plurality of sets which are connected in parallel, and each set is of, preferably, ten lights connected in series with one flasher bulb 50. As will be described hereinafter, when power is first applied to a set, all the lights will go on; however, as the flasher bulb 50 heats and breaks circuit, the set of ten lights 40 associated therewith will go off. As the flasher bulb 50 cools and again makes contact with that particular set, it will again be lit such that the ten lights will blink on and off in a random sequence. Thus, assuming for purposes of description that the lights were merely plugged into an outlet, they would provide a multitude of random light patterns; on the other hand, when the lights are connected to the sound amplitude amplifiers as described hereinafter, the effect is completely different and unexpected and is referred to as controlled randomness wherein some lights turn on and off and other stay on longer. While all the lights will be working and blinking, the lights are not working in unison with each other. As one set may be switching on and off, other sets are inactive and operating in response to the sound source. Because there are so many lights and there is literally an infinite set of patterns, the human eyes will be tricked into seeing different patterns.

Referring now to FIG. 3 of the drawings, there is illustrated one example of a circuit which may be employed in practicing applicant's invention. The circuit 42 illustrates a microphone 52 which senses the sounds given off by the records, tapes and the like which are providing music. An audio amplifier 54 having an AC source 56 provides the signal across dropping resistors 58 and 60 to parallel rheostats 62, 64 and 66. The rheostats which are controlled by the levers 28 communicate the appropriate signal to SCR units 68, 70 and 72, respectively. These SCR units, in turn, communicate the signal to the appropriate loads. In the present situation the spotlights 22 are connected in parallel with the banks of lights 38 and the neon lights 26. Suitable circuitry including the on-off switch 24 and means for connecting and operating the electric motor 32 are not shown. A power source is provided and connected to the system via the full-wave bridge rectifier 78. It can thus be seen that each bank of lights is connected to a channel. If one channel is in operation, normally the color organ circuit 42 pulses the light in time relationship with the music. At first, as aforementioned, all fifty lights 40 will pulse on and off; however, as the tempo increases or the duration of "on" impulses increases, the flasher units 50 will heat up, thereby turning some of the sets of ten lights off. Since there are five sets of ten lights per channel, most of the time at least one or more sets of ten will be flashing with the music. Sometimes five of five will flash; but whatever set is on when there is a signal, the set will flash with the music. It should also be noted that the colored spotlights 22 are electrically connected to the circuit 42 and will turn on and off in response to the signal generated by the circuit. In addition to the banks of lights 38 carried by the support rod 36, the support shelf 30 carries a plurality of hooks 43 which support stationary banks 38.

Preferably the motor 32 rotates at one revolution per minute. This provides an extremely pleasing effect because of the peculiar characteristics of the material used for a defuser.

The prismatic panel 20 may be covered with a vacuum metalized plastic; thus, it may be used as a one-way mirror when the light banks 38 are not on. When the light banks 38 are operable, the device 10 operates in the manner aforementioned.

Referring now to FIG. 5 of the drawings, there is illustrated an example of the present invention wherein the prismatic panels 20 are replaced by apertured panels 79 having apertures 81 provided in an even manner across the face of each panel; that is, the apertures 81 are placed parallel and perpendicular to the length and width of the panel 79. This provides a unique effect when the light passing through the apertures 81 is projected on a wall. The person viewing the same receives a three-dimensional effect which is due to the lights 40 carried by the rotating arm 36 moving toward and away from the apertures 81 at a changing rate.

FIG. 6 illustrates another unique improvement in the form of a prismatic panel 80 having changing prism sizes laterally across the face of the panel. For example, the left side of the panel would be provided with one type of prism configuration 82. Gradually, the prism configuration 82 is changed as you move toward the center of the panel 80. This will result in an effect which will be completely different in that different light images are produced as the rotating lights move past the panel having changing prismatic configurations.

It can thus be seen that applicant has provided a new and improved lighting display which is not disclosed or suggested in any of the prior art references.

It should be understood by those skilled in the art of lighting displays that other forms of applicant's invention may be had, all coming within the spirit of the invention and scope of the appended claims.

What is claimed is as follows:

1. In a system for varying the intensity of a plurality of lights in accordance with plural channel audio amplitude signals, a display comprising:

a microphone responsive to ambient sound;

an audio amplifier for amplifying said ambient sound and directing said amplified sound energy to a plurality of audio amplitude responsive channels;

a plurality of colored spotlights directable against the walls and ceiling of a room in which said system is operated, the intensity of said spotlights responsive to said sound amplitude;

a housing having multi-sided prismatic openings through which light paths are provided to permit the passage of light from the interior of said housing, said housing having a top wall, a mirrored back wall and a mirrored bottom wall;

a plurality of banks of lights, each of said banks being responsive to a separate one of the channels of audio amplitude signals, each of said banks including a plurality of lights, each of said banks being responsive respectively to the amplitude of an associated channel of audio sound signals, each of said banks including a plurality of sets connected in parallel, each set being of a selected number of lights connected in series with one flasher unit, said lights being responsive to said separate channels and being turned on and off in a random fashion by said flasher units;

means for mounting a selected number of said banks in a stationary position within said housing;

a motor mounted to the interior surface of said top wall;

a laterally disposed arm member carried by said motor and rotatable in a generally horizontal plane; and means mounting a selected number of said banks to the opposite ends of said rotating arm member to rotate said last-mentioned banks about a vertical axis.

2. The display defined in claim 1 wherein the prismatic panels are provided with laterally changing prismatic configurations across the face of the panel.

3. The display defined in claim 1 wherein the multi-sided openings are in the form of panels having a plurality of apertures wherein the apertures are placed parallel and perpendicular to the length and width of the panel.

* * * * *